US012471718B2

(12) United States Patent
Redwanz

(10) Patent No.: US 12,471,718 B2
(45) Date of Patent: Nov. 18, 2025

(54) SUPPORT ASSEMBLY

(71) Applicant: VITRA AG, Birsfelden (CH)

(72) Inventor: Boris Redwanz, Vicques (CH)

(73) Assignee: VITRA AG, Birsfelden (CH)

( * ) Notice: Subject to any disclaimer, the term of this patent is extended or adjusted under 35 U.S.C. 154(b) by 216 days.

(21) Appl. No.: 18/261,048

(22) PCT Filed: Jan. 11, 2022

(86) PCT No.: PCT/EP2022/050378
§ 371 (c)(1),
(2) Date: Jul. 11, 2023

(87) PCT Pub. No.: WO2022/152664
PCT Pub. Date: Jul. 21, 2022

(65) Prior Publication Data

US 2024/0057782 A1 Feb. 22, 2024

(30) Foreign Application Priority Data

Jan. 12, 2021 (CH) ..... 00020/21

(51) Int. Cl.

| | |
|---|---|
| ***A47C 7/32*** | (2006.01) |
| ***A47C 7/40*** | (2006.01) |
| ***A47C 31/02*** | (2006.01) |
| *A47C 7/28* | (2006.01) |

(52) U.S. Cl.
CPC ..... *A47C 31/023* (2013.01); *A47C 7/40* (2013.01); *A47C 7/282* (2013.01)

(58) Field of Classification Search
CPC ..... A47C 7/282; A47C 31/023
See application file for complete search history.

(56) References Cited

U.S. PATENT DOCUMENTS

| | | | | |
|---|---|---|---|---|
| 6,550,866 | B1 * | 4/2003 | Su | A47C 7/282 297/452.64 |
| 6,688,690 | B2 * | 2/2004 | Watson | A47C 7/282 297/316 |
| 6,758,528 | B2 * | 7/2004 | Kawashima | A47C 7/282 297/452.56 |

(Continued)

FOREIGN PATENT DOCUMENTS

| | | | | |
|---|---|---|---|---|
| DE | 10337267 | B3 * | 2/2005 | A47C 31/023 |
| DE | 2009 059699 | A1 | 8/2010 | |

(Continued)

OTHER PUBLICATIONS

International Search Report and Written Opinion mailed Apr. 21, 2022 in International Application No. PCT/EP2022/050378.

*Primary Examiner* — Rodney B White
(74) *Attorney, Agent, or Firm* — MEDLER FERRO WOODHOUSE & MILLS PLLC

(57) ABSTRACT

A support assembly for a chair, the support assembly including a carrier shell, a receiving shell mountable on the carrier shell, and a locking element. The carrier shell and the receiving shell each have, in an edge region, connection structures formed in a manner complementary to one another. The connection structures are configured to engage in one another in the mounted state in such a way that they form a through-channel into which the locking element can be introduced.

20 Claims, 7 Drawing Sheets

(56) References Cited

U.S. PATENT DOCUMENTS 6,779,849 B1 * 8/2004 Harper ..... A47C 7/282
297/440.11
6,842,959 B2 * 1/2005 Coffield ..... A47C 21/022
29/451
6,899,398 B2 * 5/2005 Coffield ..... B29C 45/14065
297/452.56
6,942,300 B2 * 9/2005 Numa ..... A47C 7/40
297/452.56
6,957,861 B1 * 10/2005 Chou ..... A47C 3/18
297/452.64
7,029,071 B2 * 4/2006 Watson ..... A47C 7/282
297/411.36
7,066,550 B1 * 6/2006 Su ..... A47C 31/023
297/452.64
7,096,549 B2 * 8/2006 Coffield ..... A47C 31/02
29/91.1
7,159,293 B2 * 1/2007 Coffield ..... A47C 31/023
29/451
7,425,039 B2 * 9/2008 Lin ..... A47C 31/023
297/452.56
7,647,714 B2 * 1/2010 Coffield ..... B29C 45/14065
297/445.1
8,251,454 B2 * 8/2012 Tsukiji ..... A47C 31/023
297/223
9,986,845 B1 * 6/2018 Hsieh ..... A47C 7/282
10,477,972 B2 * 11/2019 Su ..... A47C 7/742
10,674,826 B2 * 6/2020 Norman ..... A47C 7/28
10,681,992 B2 * 6/2020 Wang ..... A47C 7/28
10,743,677 B2 * 8/2020 Schmitz ..... A47C 3/30
10,813,463 B2 * 10/2020 Deevers ..... A47C 7/46
10,918,220 B2 * 2/2021 Wang ..... A47C 7/282
11,172,765 B1 * 11/2021 Zurian ..... B64D 11/0647
11,357,329 B2 * 6/2022 Deevers ..... A47C 7/38
11,510,502 B2 * 11/2022 Schmitz ..... A47C 7/40
11,602,223 B2 * 3/2023 Deevers ..... A47C 7/029
11,690,457 B2 * 7/2023 Koch ..... A47C 7/40
297/452.18
11,786,039 B2 * 10/2023 Deevers ..... A47C 7/46
297/301.1
11,812,866 B2 * 11/2023 Schmitz ..... A47C 7/36
11,910,934 B2 * 2/2024 Deevers ..... A47C 7/40
12,161,232 B2 * 12/2024 Deevers ..... A47C 3/021
12,226,025 B2 * 2/2025 Deevers ..... A47C 7/025
2002/0195863 A1 * 12/2002 Su ..... A47C 7/40
297/440.11
2003/0071509 A1 * 4/2003 Neil ..... A47C 7/16
297/440.11
2004/0121119 A1 * 6/2004 Levey ..... B29C 65/362
428/122
2004/0262975 A1 * 12/2004 Su ..... A47C 31/023
297/440.11
2005/0194829 A1 * 9/2005 Aerts ..... A47C 31/023
297/452.59
2005/0248205 A1 * 11/2005 Neil ..... A47C 7/282
297/452.18
2007/0170756 A1 * 7/2007 Kang ..... A47C 7/282
297/452.56
2008/0079307 A1 * 4/2008 Su ..... A47C 7/282
297/452.56
2010/0007190 A1 * 1/2010 Johnson ..... A47C 31/023
297/440.15
2014/0054947 A1 * 2/2014 Su ..... A47C 7/40
297/452.18
2023/0292925 A1 * 9/2023 Koch ..... A47C 7/40
297/452.18
2024/0148160 A1 * 5/2024 Plant ..... A47C 31/023
2024/0285080 A1 * 8/2024 Zwick ..... A47C 31/02

FOREIGN PATENT DOCUMENTS

EP 1346665 A1 * 9/2003 ..... A47C 31/02
EP 231 330 B1 5/2019
JP 2003000400 A * 1/2003 ..... A47C 31/023
JP 2008-080092 A 4/2008
JP 2009-011694 A 1/2009
JP 2019-017745 A 2/2019
WO WO-2018104283 A1 * 6/2018 ..... A47C 31/023

* cited by examiner

SUPPORT ASSEMBLY

TECHNICAL FIELD

The invention relates to a support assembly, in particular for the backrest of a seat device, which has a carrier shell and a receiving shell that can be mounted on the carrier shell. Such support assemblies, which are regularly formed from a firmer and a more flexible component, are usually provided for providing various ergonomic properties.

BACKGROUND

Support assemblies, in particular for backrests of chairs, which support the backs and are at the same time comfortable, are used both in private and in professional fields. Especially in the case of office or work chairs, on which the user usually spends a large amount of time, both the support of the back and a comfortable ergonomic receiving or resting of the back are important.

Chairs are known in the prior art, in particular office or work chairs, the backrests of which have a frame over which a mesh comprising openings is applied. This gives the backrest a certain flexibility, ensures air permeability and, depending on the tension of the mesh, supports the user's back, for example in the lumbar region.

The disadvantage of these solutions, however, is often that the mesh is not particularly loadable. Depending on the material, yielding occurs with increasing service life, as a result of which the support function decreases. Furthermore, a backrest made of a mesh material is also easily destroyed. A further disadvantage is the assembling, which is complicated due to the corresponding tensioning of the mesh.

Another solution known in the prior art for providing chairs which both provide support for the back and are comfortable is padded chairs having adjustment options for supporting different parts of the back, such as the lumbar region.

EP 3 231 330 B1, for example, discloses a backrest for a chair comprising a backrest frame which defines breast, shoulder, lumbar and pelvic regions, the backrest frame having a pair of upright support posts spaced apart from one another, the support posts comprising upper and lower ends. In this case, the upper ends are connected by an upper support transverse element, and the lower ends are connected by a lower support transverse element, the support posts and transverse elements jointly defining a window in the backrest frame. The backrest frame has a front side and a rear side which is opposite the front side. The backrest also comprises a flexible back support surface which is mounted on the backrest frame. Furthermore, the backrest comprises a lumbar mechanism which is positioned between the backrest frame and the flexible back support surface, the lumbar mechanism having a lumbar cushion. The lumbar cushion is designed as a flexible, hollow, tubular pillow, at least a portion of the lumbar cushion being in engagement with the flexible back support surface, and the lumbar cushion being visible through the window in the backrest frame.

However, such chairs are frequently very complex in design and are laborious to produce. In addition, the cushions can often become worn from use after a relatively short time. Furthermore, depending on the cover, the care of the cushions can be complicated.

In order to be able to support the different back regions, office or work chairs, for example, have a backrest divided into multiple partial regions. These can be adjusted to different extents so that a chair that is as ergonomic as possible for the user is provided.

Disadvantages of such chairs are, on the one hand, the early occurrence of signs of usage and, on the other hand, the comparatively complex structure, which also represents a particular challenge with regard to production.

The object of the present invention is to provide a support assembly which is comparatively simple to manufacture and assemble, in particular for a backrest of a chair, which is robust and flexible at the same time, and ensures an ergonomically favorable support of a user's back area.

SUMMARY

According to the invention, the object is achieved by a support assembly and a chair as described herein with advantageous embodiments of the invention being also described.

The essence of the invention is the following: a support assembly for a chair comprises a carrier shell, a receiving shell that is mountable on the carrier shell, and a locking element. The carrier shell and the receiving shell each have connection structures formed in a manner complementary to one another in an edge region. The connection structures are configured to engage in one another in the mounted state in such a way that they form a through-channel into which the locking element can be introduced.

The support assembly can be provided for a component of a chair which assumes a support function and in particular receives or supports a body part of a user of the chair when the user sits on the chair. For example, it can be designed to form a seat or an armrest. In a particularly advantageous manner, however, the support assembly is designed as or for a component of a backrest of the chair and can be referred to as a backrest arrangement.

By using only three components, namely the carrier shell, the receiving shell and the locking element, a particularly simple manufacture and assembly can be ensured. By the connection structures being designed to form the through-channel, and the locking element being designed to be inserted into this through-channel, an efficient tool-free and particularly stable assembly of the support assembly, for example as a backrest, can be achieved.

The term "chair" is understood in the present case to mean any known form of a seat device or of seating furniture. In particular, this can be an office chair or a work chair.

The term "shell" is generally used here for a dimensionally stable element which has a substantially larger surface area or length and width extension than thickness. A shell in the sense of the present disclosure is formed over large parts as a plate, it not being smooth or flat but rather being shaped in a manner adapted to an intended use, for example curved; it can also have multiple openings or apertures. By way of example, the receiving shell can be adapted in a side view to a body part of a user of the chair, which body part it receives when used as intended. In a backrest, the receiving shell can be formed in a manner ergonomically adapted to the user's back. The term "dimensionally stable" is understood in the present case to mean that the corresponding element maintains its shape, in any case when no force acts on it. An in particular elastic deformation during a force application typically nevertheless occurs.

The term "receiving shell" typically refers to a side of the support assembly facing the user of the chair, on which the body or the back of the user leans. Thus, the receiving shell can receive the body or the back of the user when they sit on the chair.

The term "carrier shell" typically denotes a side of the support assembly facing away from the user, on which the receiving shell is mounted, and which is generally formed from a substantially solid plastics shell, i.e., the carrier shell is preferably less flexible than the receiving shell. The carrier shell therefore preferably forms a holder for the receiving shell.

In the present case, the term "edge region" refers to a portion along a peripheral end of the associated receiving or carrier shell. The peripheral end of the receiving or carrier shell typically comprises multiple edge regions. In the case of a backrest, in which the receiving and carrier shells are usually quasi rectangular in the view, the edge regions can form vertically extending edges of the backrest, i.e., preferably without the upper edge and the lower edge. In the event that the support assembly is used in another way in a seat device, for example in a seat, multiple edge regions may also be formed peripherally or on three sides of the seat device.

Preferably, the carrier shell and the receiving shell are configured as follows: the carrier shell is formed so as to be dimensionally stable and has a first elasticity. The receiving shell is also formed so as to be dimensionally stable and has a second elasticity. The second elasticity of the receiving shell is higher than the first elasticity of the carrier shell.

The term "elasticity" is generally understood here to mean the ability of a material to reverse a change in shape, caused by external action, using its own force. Here, the elasticity of a material is thus said to be high when the material is easily deformable. This means that a material has a comparatively high elasticity if it can be deformed with comparatively little force expenditure. The lean-on shell can preferably be designed as a flexible membrane made of a dimensionally stable plastics material. Such a configuration of the carrier and receiving shells enables a comparatively high mobility or flexibility when receiving a body part. For example, the relatively soft receiving shell can enable ergonomic receiving of a user's back and allow a movement of the back to a certain extent, without the back being no longer supported.

The "locking element" is introduced or inserted into the through-channel formed by the complementary connection structures and projects through it in the mounted state. The connection structures, and with them the receiving shell and the carrier shell, are thus fixedly fastened or locked to one another. In this case, the locking element ensures in particular a form-fitting or form/force-fitting connection between the carrier shell and the receiving shell.

The "connection structures formed in a manner complementary to one another" in any case comprise such geometric embodiments which are capable of engaging in one another and then together defining the through-channel for the locking element. In this case, the mutually complementary connection structures can have different geometries from one another, or they can have substantially the same geometry.

The "through-channel" is intended to be an approximately tunnel-shaped cavity or free space which extends through the connection structures when these engage in one another, and thus passes through the locking structures. It enables a comparatively easy and, in particular, tool-free introduction (and optionally a tool-free release) of the locking element. The through-channel can extend continuously. As a rule, however, it is not completely closed over its entire length. It can have in particular alternately arranged opening gaps which can be arranged approximately on both sides of the edge region. The through-channel preferably has a round cross section, but it can also have a triangular, square, rectangular or polygonal cross section. The cross section of the locking element corresponds to the cross-sectional shape of the through-channel in such a way that a secure mounting of the receiving shell on the carrier shell can be ensured. In this case, the cross-sectional shapes of the through-channel and the locking element do not necessarily have to be identical.

Preferably, either the connection structure of the carrier shell, the connection structure of the receiving shell or the connection structure of the carrier shell and the connection structure of the receiving shell has claws spaced apart from one another. In this context, the term "claw" is understood to mean a finger-shaped or rod-shaped extension which is typically curved at least in part. Such a configuration of the corresponding connection structure provides the prerequisite for a particularly simple interlocking for creating the through-channel. An efficient assembly can thus be made possible.

Preferably, the claws comprise an engagement region, a first connection region and a support region. As a result, the prerequisite for an optimal interaction of the two connection structures can be achieved in that geometric configurations are provided which are particularly well suited for a complementary cohesion.

Preferably, the connection structure of the carrier shell or the connection structure of the receiving shell has openings spaced apart from one another. In this case, the mutually spaced openings preferably receive the claws of the other connection structure when the connection structures engage in one another. In this case, the corresponding connection structure is preferably configured in the form of a bead. In this case, the mutually spaced openings are in each case introduced between adjacent side walls of the bead. The "bead" is generally designed in the form of a substantially rounded thickening, which, however, also has geometries complementary to the claws, which are preferably also designed for flush termination to the outside. As a result, in particular a flush mounting of the carrier shell and the receiving shell in the edge region can also be made possible, i.e., a substantially smooth surface in particular on the side of the edge region of the receiving shell facing the user.

In this case, the connection structures are preferably configured to engage in one another in that the openings each receive one of the claws, respectively. In this way, a simple and efficient interlocking for creating the through-channel can be achieved.

Preferably, the connection structure, preferably designed in the form of a bead, comprises a supporting projection, a second connection region and a receiving region. In this way, the complementary design of the two connection structures and their corresponding mounting can be accomplished particularly advantageously. In this case, the supporting projection and the receiving region are preferably each arranged in the region of the openings. Further preferably, the second connection region is in each case arranged in one of the side walls of the bead, an opening preferably being provided in each case between two adjacent side walls of the bead.

In particular, the complementary engagement regions and supporting projections on the one hand, and the complementary supporting regions and receiving regions on the other hand, are preferably designed in such a way that they enable an uncomplicated assembly, wherein it is possible for a form-fitting cohesion between the two connection structures to already be provided, at least in certain directions, even without the locking element being introduced.

Preferably, the connection structure of the receiving shell and the connection structure of the carrier shell have alternately arranged partial roundings which are designed to form the through-channel having a substantially round cross section in the mounted state. In this respect, the partial roundings are oriented opposite one another. Preferably, the partial roundings are provided in the first connection region of the claws and in the second connection region of the bead. They comprise the locking element, when viewed in cross section, substantially entirely, it being possible for one partial rounding to encompass slightly more than half the locking element and for the other partial rounding to encompass slightly less than half the locking element.

Preferably, the support projection of the connection structure or of the bead, and a retaining element of the claws, form a lateral path limitation of the receiving shell. In the case of a lateral tensile load of the receiving shell, that is to say, a substantially laterally inwardly directed force component, for example when a user leans against the receiving shell, corresponding stop surfaces of the supporting projection and of the retaining element form the lateral path limitation (of the receiving shell under tensile load). The "laterally inwardly directed force component" is thus the force component acting from the edge regions substantially in the direction of the user, when leaning.

Preferably, a stop projection of the bead and a contact region between adjacent claws form a rear path limitation. In the case of a rear pressure load of the receiving shell, i.e., a force component which is substantially directed toward the carrier shell, for example when a user leans back in the backrest or sits on a receiving shell, corresponding stop surfaces of the stop projection and the contact region form the rear path limitation (of the receiving shell under compressive load). The "backwards-directed force component" is thus in the present case the force component which is to act substantially from the receiving shell on the carrier shell, in the leaning direction of the user.

Preferably, the carrier shell and/or the receiving shell are formed of a thermoplastic plastics material. This material is particularly suitable for production in the injection molding method. In addition, thermoplastics are also flexible or resilient in the solid state, so that accordingly a large bandwidth of desired elastic properties can be efficiently adjusted.

Preferably, the carrier shell and/or the receiving shell are provided with perforations (or breakthroughs). In this context, "perforation" is understood to mean a plurality of holes or openings in the corresponding shell. The perforations or openings can be of a size in the centimeter range, in order to develop an intended effect. By means of the number, arrangement and size of the corresponding perforations (or breakthroughs), the flexibility properties can be adjusted particularly finely, i.e., in particular also in selected regions of the receiving shell or the carrier shell, which are decisive for certain back parts.

Preferably, the perforations (or breakthroughs) are circular or polygonal, in particular hexagonal. In particular, they can vary over the height of the backrest of a chair with respect to their size and/or orientation, in order to adjust the flexibility properties as desired.

Preferably, the locking element comprises a rod-shaped element, preferably quasi round in cross section, which is formed from a resiliently bendable plastics material. In this way, it can be ensured that the locking element can be guided into and through the through-channel particularly well, i.e., in particular also in the region of curvatures in the edge region of the support assembly or the backrest. Furthermore, such plastics rods can be designed to be sufficiently robust in order to be able to absorb a suitable load.

Preferably, the carrier shell and the receiving shell in any case have a convex curvature in the edge region, i.e., the curvature is oriented towards the back of a user in order to be able to ensure a corresponding support, in particular in the lumbar region.

A further aspect of the invention relates to a chair comprising a seat mounted on a seat support and a backrest support fastened to the seat support, a support assembly according to the invention being mounted on the backrest support. The chair can in particular be an office chair or a work chair.

BRIEF DESCRIPTION OF THE DRAWINGS

Further advantageous embodiments of the invention emerge from the following description of embodiments of the invention with the aid of the schematic drawing. In particular, the chair according to the invention is described in more detail below with reference to the accompanying drawings on the basis of embodiments.

DETAILED DESCRIPTION

Figure 1:
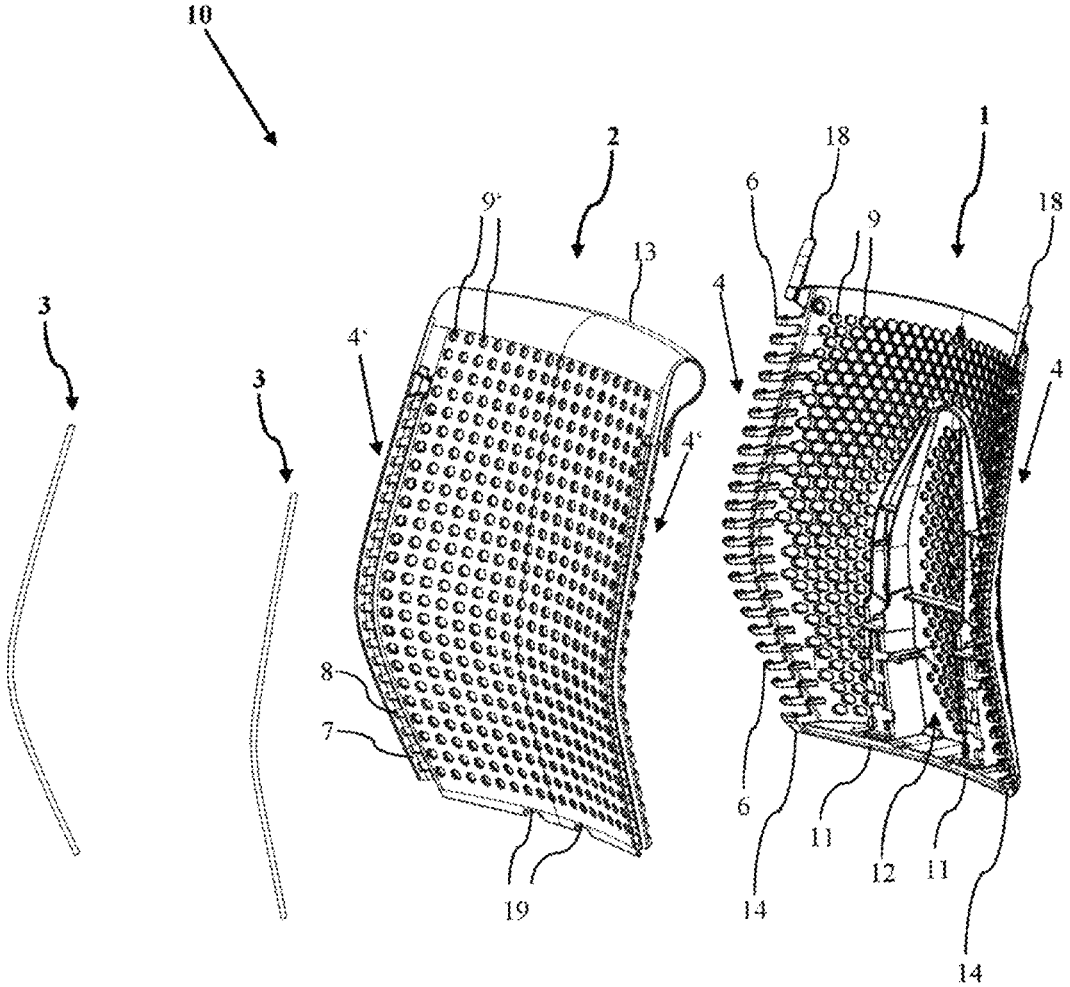
FIG. 1: shows an exploded view of a support assembly according to the invention comprising a carrier shell, receiving shell and locking element.

Certain expressions are used in the following description for practical reasons and are not to be understood as limiting. The words "right," "left," "bottom" and "top" denote directions in the drawing to which reference is made. The terms "inward," "outward," "below," "above," "left," "right" or similar are used to describe the arrangement of designated parts relative to one another, the movement of designated parts relative to one another and the directions toward or away from the geometric center of the invention and designated parts thereof as shown in the drawings. This spatial relative information also comprises different positions and orientations from those shown in the drawings. For example, if a part shown in the drawings is reversed, elements or features that are described as "below" are then "above." The terminology comprises the words expressly mentioned above, their derivations and words with similar meanings.

In order to avoid repetitions in the drawings and the associated description of the different aspects and embodiments, certain features are to be understood as common for different aspects and embodiments. The omission of an aspect in the description or a drawing does not suggest that this aspect is missing in the associated embodiment. Rather, such omissions are made for the sake of clarity and to avoid repetition. In this connection, the following statement applies for the entirety of the further description: If, for purposes of clarity in the drawing, a figure contains reference signs, but these are not mentioned in the text of the description relating directly thereto, reference is made to their explanation in preceding figure descriptions. If reference signs are also mentioned in the text of the description relating directly to a figure that are not included in the corresponding figure, reference is made to the preceding and following figures. Similar reference signs in two or more drawings represent similar or identical elements.

In FIG. 1 a support assembly 10 according to the present invention is shown in an exploded view. The support assembly 10 comprises, as main components, a carrier shell 1, a receiving shell 2 and two locking elements 3 for mounting the receiving shell 2 on the carrier shell 1. The carrier shell 1 is in this case designed as a hard or less flexible injection-molded part. The receiving shell 2 is regularly designed as a rather soft and flexible but dimensionally stable injection-molded part, preferably in the form of a flexible matrix, on which a user rests their back. The receiving shell 2 serves in particular to provide flexibility properties which can be adjusted to selected back regions. The rod-shaped locking elements 3 are formed from a bendable plastics material and serve for mounting the receiving shell 2 on the carrier shell 1. In any case, the receiving shell 2 and the carrier shell 1 have a concave curvature in the horizontal, at least in portions.

The receiving shell 2 comprises an upper part 13, which is optionally configured in the form of a head rest and/or a neck rest. In this embodiment, the receiving shell 2 has substantially circular perforations or breakthroughs 9', which serve to adjust the flexibility and as ventilation openings. In their edge regions 4', the receiving shell 2 in each case has a bead 7 as the connection structure, in which mutually spaced openings 8 are made. On its underside, the carrier shell 1 has recesses 11 which serve for mounting the support assembly 10 for example on a backrest support of a chair. The receiving shell 2 has notches 19 arranged centrally on its underside, which are used to fix the receiving shell 2 on the carrier shell 1.

The carrier shell 1 has, on its upper side, two tabs 18 which can be mounted on the upper part 13 of the receiving shell 2. The tabs 18 serve to support the receiving shell 2, so that it cannot buckle in the case of loading in the upper lateral region. The carrier shell 1 preferably has hexagonal perforations or breakthroughs 9, which also serve here, in a more limited manner than in the case of the receiving shell 2, for adjustment of flexibility properties, and also as ventilation openings. The carrier shell 1 furthermore has a substantially straight or non-curved central portion 12. In its edge regions 4, the carrier shell 1 preferably comprises hook-like claws 6 which project laterally outwards from the carrier shell 1 and which are configured, for assembly purposes, in each case to be introduced into the corresponding openings 8 of the bead 7 in the edge regions 4' of the receiving shell 2.

The locking elements 3 are then introduced or inserted between the claws 6 and the bead 7, for example in the region of an insertion point 14 in the edge region 4 of the carrier shell 1, in such a way that a fixed, but basically detachable, mounting of the receiving shell 2 on the carrier shell 1 results. The support assembly 10 according to the invention is in this respect also suitable in particular for tool-free mounting at home.

Figure 2:
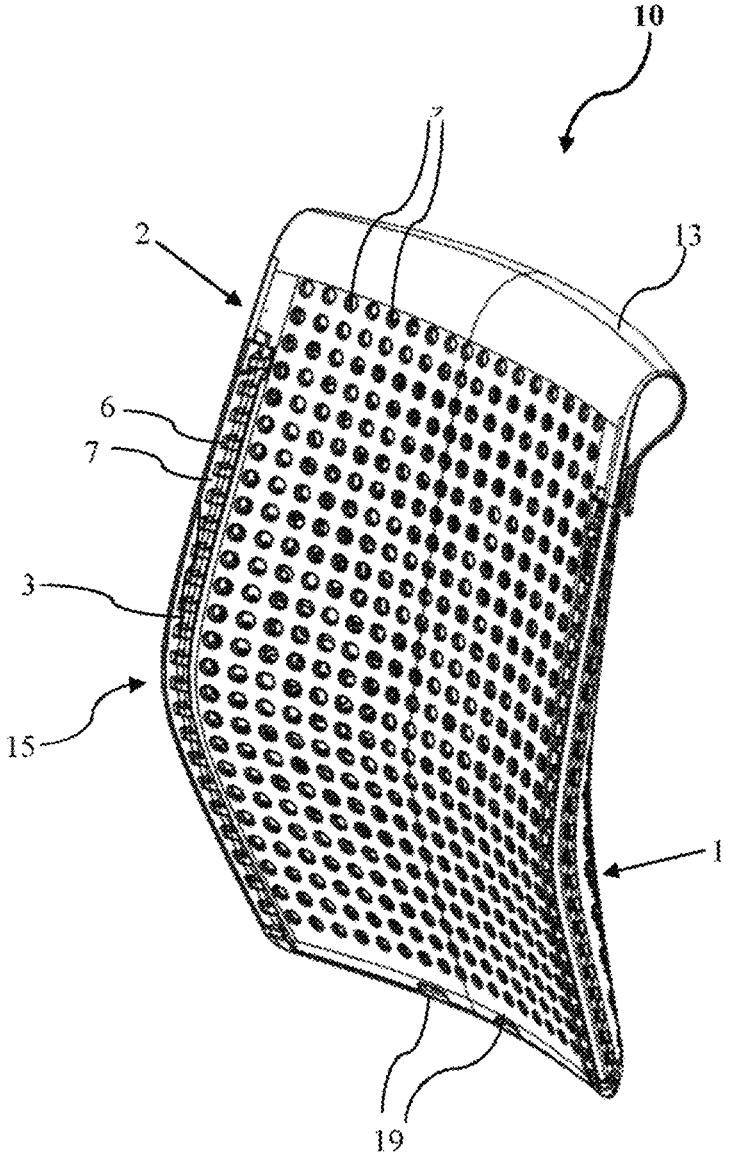
FIG. 2: shows a perspective view of a support assembly according to the invention in the assembled state.

FIG. 2 shows a fully assembled support assembly 10. The locking element 3 is now located between the claws 6 in the edge region 4' of the receiving shell 2 and the bead 7 or the openings 8 in the edge region 4 of the carrier shell 1. The support assembly 10 can thus be mounted in the region of the recesses 11 on a corresponding backrest support of a seat device, for example a work or office chair.

Figure 3:
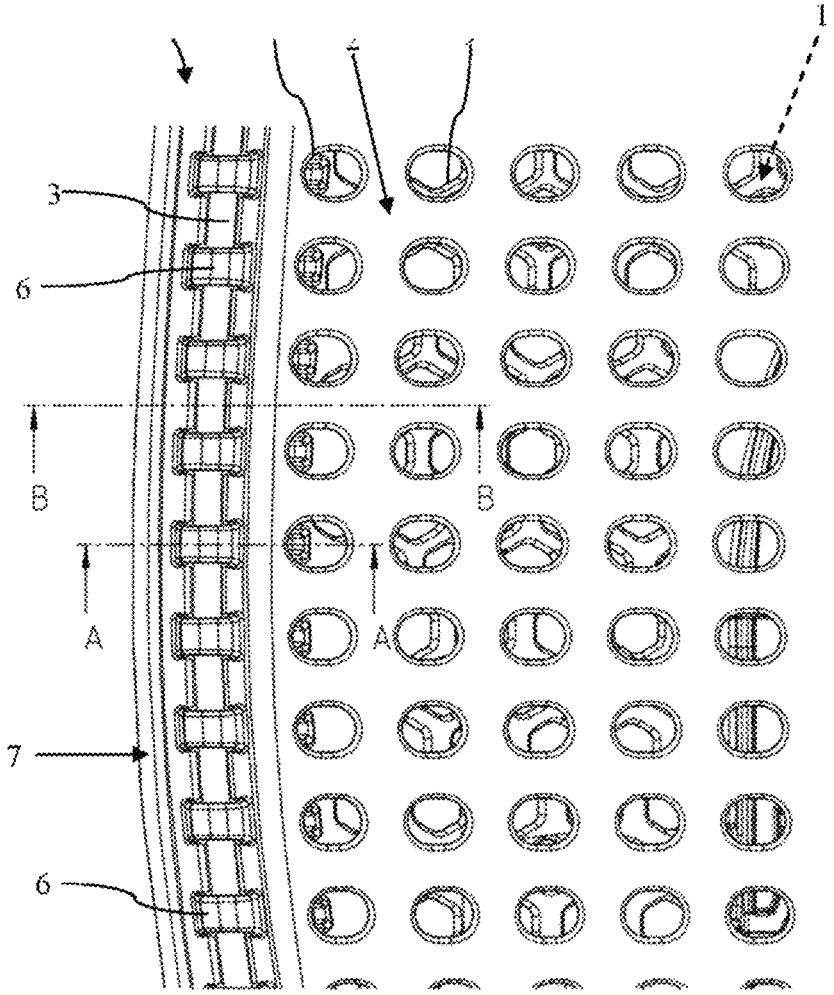
FIG. 3 shows a detail view of a side region of a support assembly according to the invention in the assembled state.

In the detail view according to FIG. 3, a detail of a lateral region of the assembled support assembly 10 is shown by a line of intersection A-A and a line of intersection B-B. In this case, the line of intersection A-A extends through the bead 7, one of the openings 8 in the bead 7, through one of the claws 6, and the locking element 3, and through one of the perforations 9 of the receiving shell 2. The line of intersection B-B extends slightly higher up, through the bead 7 (in the region between two openings 8), the locking element 3, and a part of the receiving shell 2 or the carrier shell 1.

Figure 4:
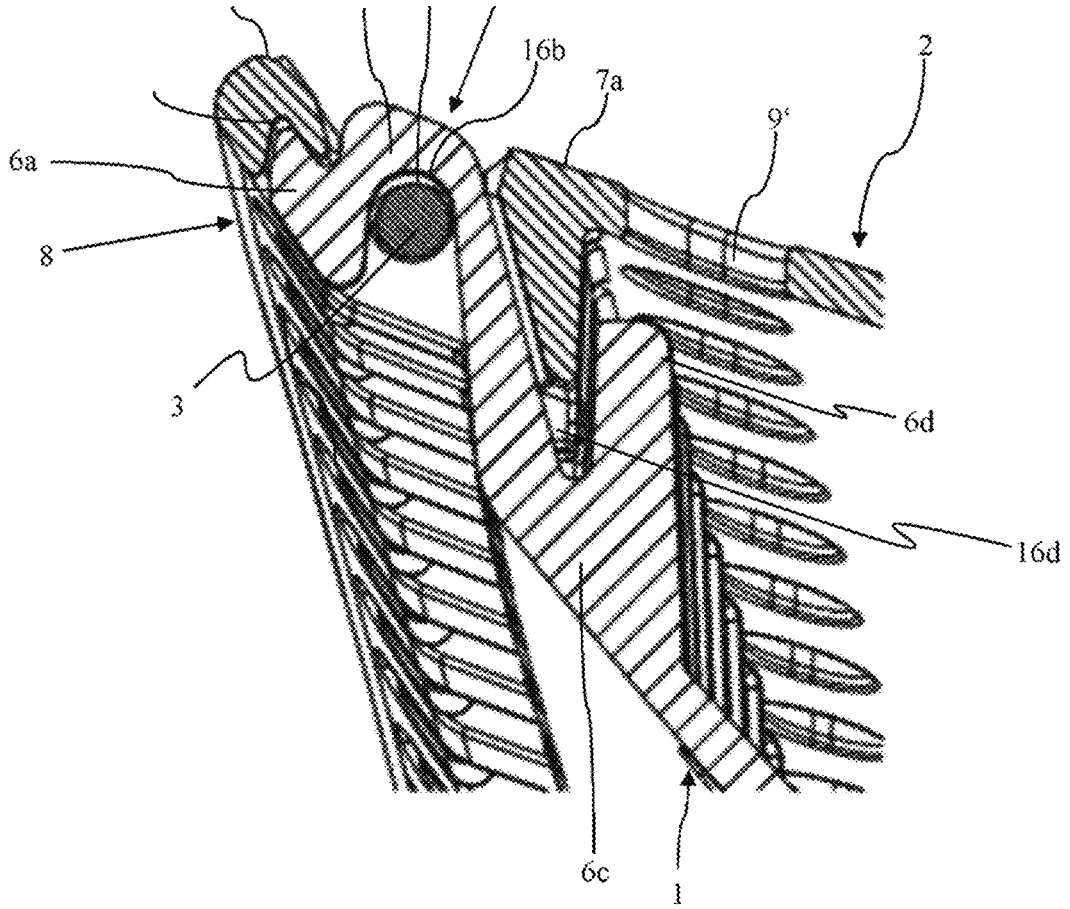
FIG. 4: shows a perspective sectional view along the line A-A in FIG. 3.

The perspective sectional view along the line A-A according to FIG. 4 illustrates the engagement of one of the claws 6 of the carrier shell 1 into a bead 7 or an opening 8 in the bead 7 of the receiving shell 2.

In this case, the claw 6 shown in cross-section has, like the other claws 6, the following structure: At its outer upper end, the claw 6 has an engagement region **6*a* which is adjoined by a first connection 6*b*. The first connection region 6*b* is in turn adjoined by a support region 6*c* which has a retaining element 6*d*, by means of which it together forms a notch 16*d***.

The parts of the bead 7 shown in cross-section (the cross-section through an opening 8) comprise a receiving region **7*c* having a notch 17*c*. On the other side of the opening 8, the bead 7 comprises a supporting projection 7*a*, which is adjoined by a perforation 9'**.

In this case, the interaction of the individual parts or portions of the bead 7 and of the claws 6 takes place as follows: The engagement region **6*a* engages in the notch 17*c* of the receiving region 7*c*. The first connection region 6*b* forms a half-rounding 16*b* as a partial rounding, which in any case surrounds the locking element 3 in part. The notch 16*d* formed by the support region 6*c* and the retaining element 6*d* receives the supporting projection 7*a***.

In this case, the retaining element **6*d* is designed in such a way that it forms a stop or a (substantially horizontal) path limitation for the supporting projection 7*a*, which is received in the notch 16*d*** at least in part.

As a result of the above-described opposing construction, the claws 6 inserted into the openings 8 of the bead 7 are initially also held without a locking element 3.

Figure 5:
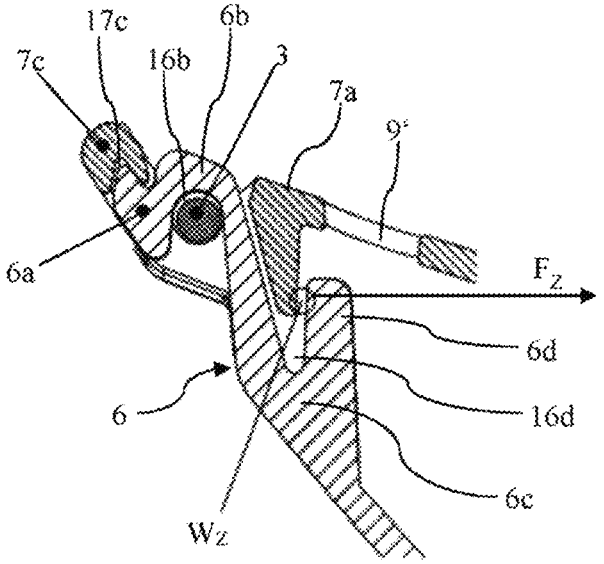
FIG. 5: shows a planar sectional view along the line A-A in FIG. 3.

The planar sectional view according to FIG. 5 in particular illustrates the lateral path limitation $W_Z$ of the receiving shell 2. In the case of a tensile load of the receiving shell 2 in the direction of the arrow $F_Z$—i.e., the substantially laterally inwardly directed force component when, for example, a user leans back in the receiving shell 2, the stop surfaces, shown circled, of the supporting projection **7*a* and of the retaining element 6*d* form the lateral path limitation $W_Z$ of the receiving shell 2** in the case of a tensile load.

Figure 6:
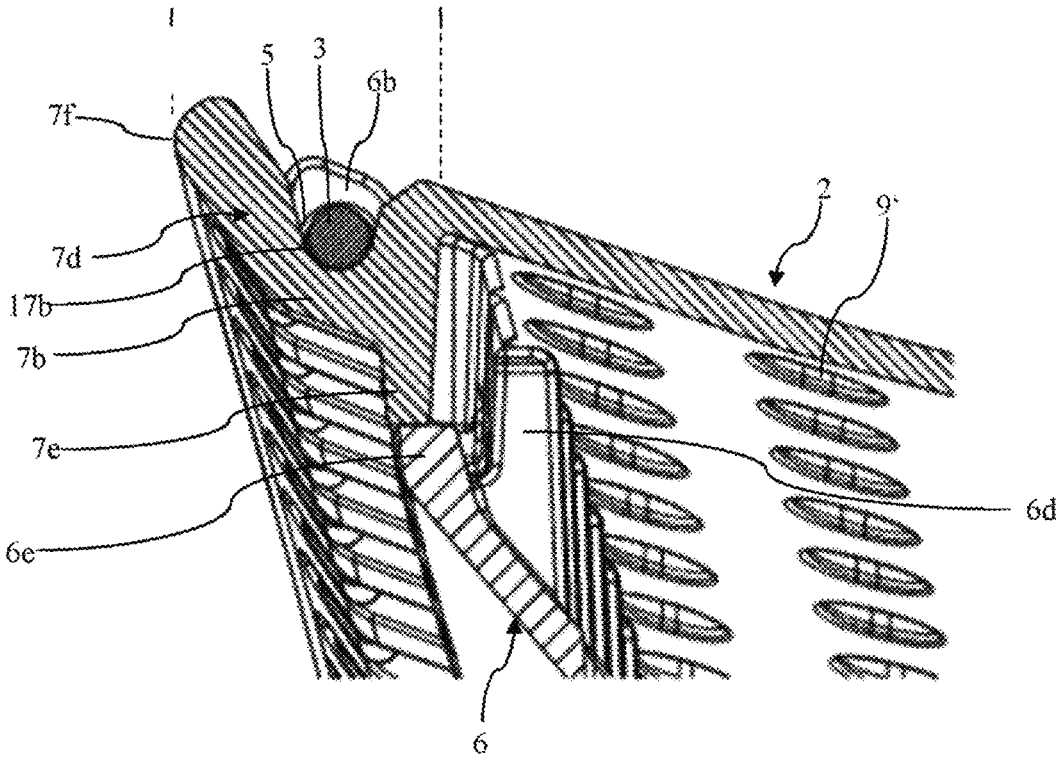
FIG. 6: shows a perspective sectional view along the line B-B in FIG. 3.

The perspective sectional view along the line B-B according to FIG. 6 illustrates the interaction of a bead 7 of the receiving shell 2 with one of the claws 6 of the carrier shell 1.

The bead 7 shown in a sectional view—outside an opening 8—initially has a rounding **7*f* at its outer upper end. The side wall 7*d* of the bead 7 comprises the second connection region 7*b*, which forms a half-rounding 17*b* as a partial rounding, which in any case surrounds the locking element 3 in part and forms a portion of the through-channel 5 for the locking element 3** together with the first connection region 6 or its half-rounding (not visible here). An essentially vertical stop projection 7*e* adjoins the second connection region 7*b*.

The region shown in cross-section between the claws 6 comprises a contact region 6*e*. A retaining element 6*d* and, above the locking element 3, a first connection region 6*b* of a claw 6, can be seen behind the sectional plane.

Figure 7:
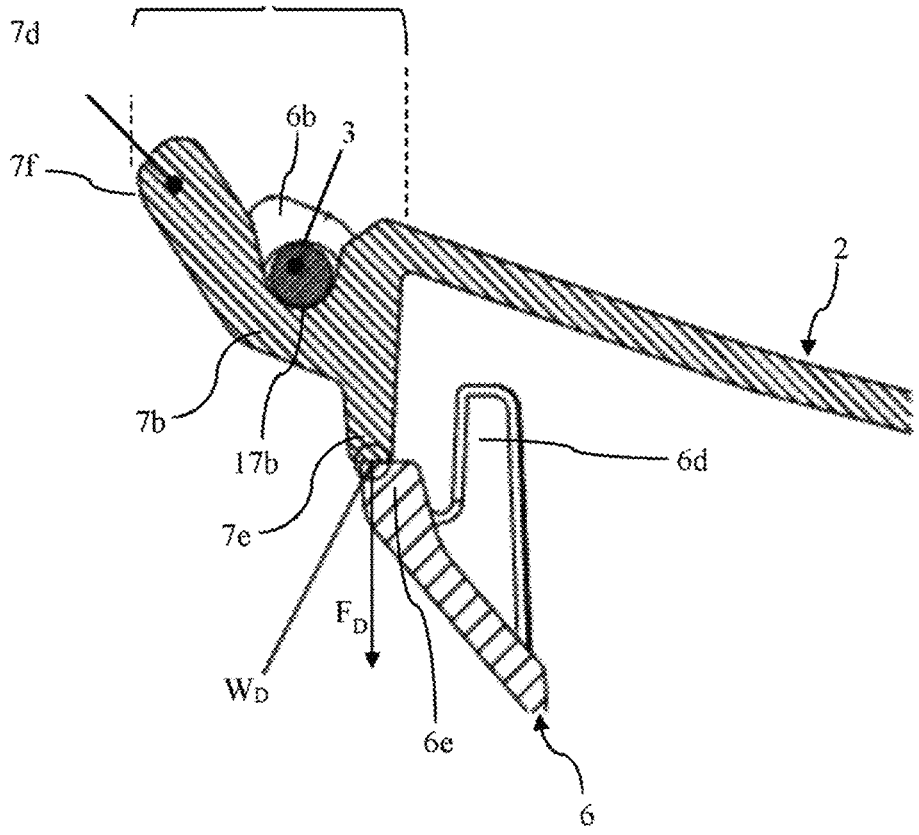
FIG. 7: shows a planar sectional view along the line B-B in FIG. 3.

The planar sectional view according to FIG. 7 in particular illustrates the rear path limitation $W_D$ of the receiving shell 2. In the case of a pressure load of the receiving shell 2 in the direction of the arrow $F_D$—i.e., the substantially backward-directed force component when, for example, a user leans back in the receiving shell 2, the stop surfaces of the stop projection 7*e* and of the contact region 6*e*, which are shown circled, form the rear path limitation $W_D$ of the receiving shell in the case of a pressure load. In this case, the retaining element 6*d* preferably does not come to rest against the inner wall of the carrier shell 1.

Figure 8:
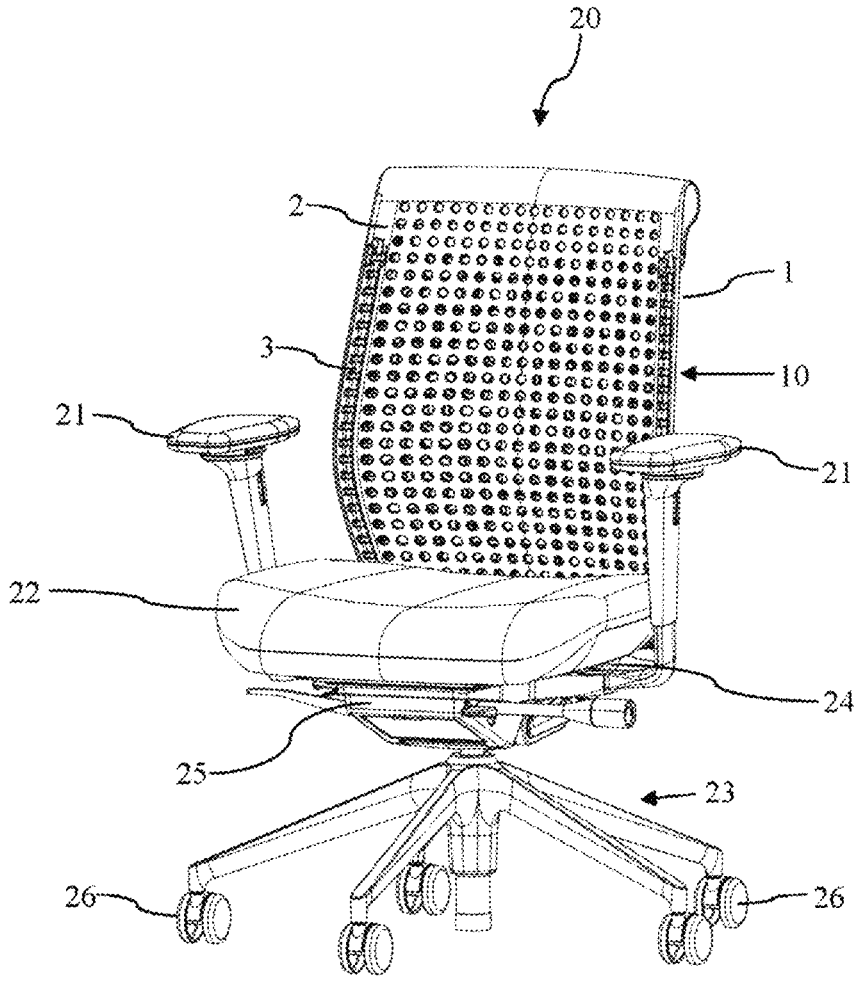
FIG. 8: shows a perspective view of a chair comprising a support assembly according to the invention for the backrest.

FIG. 8 finally shows a chair 20, by way of example, comprising a support assembly 10 according to the invention. In this case, the chair 20 comprises two armrests 21, a seat 22 which is mounted on a seat support 25, and a star-shaped foot part 23 which is arranged below the seat support and has multiple rollers 26. In addition, a backrest support 24, on which the support assembly 10 according to the invention is mounted, is fastened in the rear region of the seat support 22. In this case, the flexible receiving shell 2 is mounted on the fixed carrier shell 1 by means of the locking element 3.

| List of reference signs: | |
|---|---|
| 1 | carrier shell |
| 2 | receiving shell |
| 3 | locking element |
| 4 | edge region of the carrier shell |
| 4 | edge region of the receiving shell |
| 5 | through-channel |
| 6 | claws |
| 6a | engagement region |
| 6b | first connection region |
| 6c | support region |
| 6d | retaining element |
| 6e | contact region (between adjacent claws) |
| 7 | bead (preferred embodiment edge region 4') |
| 7a | supporting projection |
| 7b | second connection region |
| 7c | receiving region |
| 7d | side wall bead |
| 7e | contact projection |
| 7f | rounding |
| 8 | openings |
| 9 | perforations/breakthroughs of the carrier shell |
| 9' | perforations/breakthroughs of the receiving shell |
| 10 | support assembly |
| 11 | recesses |
| 12 | central portion |
| 13 | upper part of the carrier shell |
| 14 | insertion point for locking element |
| 15 | curvature |
| 16b | half-rounding (first connection region) |
| 16d | notch |
| 17b | half-rounding (second connection region) |
| 17c | notch (receiving region) |
| 18 | tabs |
| 19 | notches |
| 20 | chair |
| 21 | armrests |
| 22 | seat |
| 23 | foot part |
| 24 | backrest support |
| 25 | seat support |
| 26 | rollers |

-continued

| List of reference signs: | |
|---|---|
| FD | compressive force (arrow) |
| FZ | tensile force (arrow) |
| WD | path limitation in the pressure direction |
| WZ | path limitation in the tensile direction |

What is claimed is:

1. A support assembly for a chair, comprising:
a carrier shell;
a receiving shell which can be mounted on the carrier shell; and
a locking element,
wherein the carrier shell and the receiving shell each have, in an edge region, a connection structure which are formed in a manner complementary to one another, wherein the connection structure of the carrier shell and the connection structure of the receiving shell are configured to engage in one another, in a mounted state, in such a way that they form a through-channel into which the locking element can be inserted, and
wherein the connection structure of the carrier shell, the connection structure of the receiving shell, or both the connection structure of the carrier shell and the connection structure of the receiving shell have claws spaced apart from one another.

2. The support assembly according to claim 1, wherein the claws comprise an engagement region, a first connection region and a support region.

3. The support assembly according to claim 2, wherein the first connection region of the claws and second connection region have partial roundings or partial rounded portions, which are configured to form the through-channel, having a substantially round cross section, in the mounted state.

4. The support assembly according to claim 2, wherein a supporting projection of the connection structure and a retaining element of the claws form a lateral path limitation of the receiving shell.

5. The support assembly according to claim 1, wherein either the connection structure of the carrier shell or the connection structure of the receiving shell has openings spaced apart from one another.

6. The support assembly according to claim 5, wherein a contact projection and a stop region between adjacent claws form a backward-directed path limitation.

7. The support assembly according to claim 5, wherein the connection structure of the carrier shell and the connection structure of the receiving shell are configured to engage in one another in that the openings each receive one of the claws, respectively.

8. The support assembly according to claim 5, wherein the connection structure, comprises a supporting projection, a second connection region and a receiving region.

9. The support assembly according to claim 8, wherein the connection structure is configured in the form of a bead.

10. The support assembly according to claim 1, wherein the connection structure of the receiving shell and the connection structure of the carrier shell have alternately arranged partial roundings which are configured to form the through-channel, having a substantially round cross section, in the mounted state.

11. The support assembly according to claim 1, wherein the carrier shell is formed so as to be dimensionally stable and has a first elasticity, the receiving shell is formed so as to be dimensionally stable and has a second elasticity, and the second elasticity of the receiving shell is higher than the first elasticity of the carrier shell.

12. The support assembly according to claim 1, wherein the carrier shell and/or the receiving shell are provided with perforations.

13. The support assembly according to claim 12, wherein the perforations are circular, polygonal or hexagonal.

14. The support assembly according to claim 1, wherein the locking element comprises a rod-shaped element, which is formed from a resiliently bendable plastics material.

15. The support assembly according to claim 14, wherein the rod-shaped element of the locking element is quasi round in cross-section.

16. The support assembly according to claim 1, wherein the carrier shell and the receiving shell have a convex curvature in the at least one edge region.

17. The support assembly according to claim 1, which comprises a second locking element, wherein the carrier shell and the receiving shell each have second connection structures, formed in a manner complementary to one another, in a second edge region opposite the edge region, wherein the second connection structures are configured to engage in one another in the mounted state in such a way that they form a second through-channel into which the second locking element can be inserted.

18. The support assembly according to claim 17, wherein the carrier shell and the receiving shell are configured such that they are spaced apart from one another between the edge regions and the second edge regions, in the mounted state.

19. A chair comprising:

a seat mounted on a seat support; and a backrest support fastened to the seat support, wherein a support assembly according to claim 1 is mounted on the backrest support.

20. The support assembly according to claim 1, wherein the support assembly is a component of a backrest of the chair.

* * * * *